US005674092A

United States Patent [19]

Wunderer

[11] Patent Number: 5,674,092

[45] Date of Patent: Oct. 7, 1997

[54] ADAPTER FOR CONNECTION TO A POWER OUTLET

[75] Inventor: Walter Wunderer, Eggenburg, Austria

[73] Assignee: Egston Eggenburger System Elektronik GmbH, Eggenburg, Austria

[21] Appl. No.: 423,600

[22] Filed: Apr. 17, 1995

[30] Foreign Application Priority Data

Apr. 19, 1994 [AT] Austria ..... 814/94

[51] Int. Cl.[6] ..... H01R 33/88

[52] U.S. Cl. ..... 439/652; 439/159

[58] Field of Search ..... 439/652, 651, 439/655, 650, 159

[56] References Cited

U.S. PATENT DOCUMENTS

| | | | |
|---|---|---|---|
| 2,448,452 | 8/1948 | Morelock | 439/651 |
| 4,224,484 | 9/1980 | Haas . | |
| 4,232,260 | 11/1980 | Lambkin . | |
| 4,897,052 | 1/1990 | Priest et al. | 439/652 |
| 5,211,569 | 5/1993 | Havens | 439/159 |

FOREIGN PATENT DOCUMENTS

| | | | |
|---|---|---|---|
| 0 091 031 | 10/1983 | European Pat. Off. . | |
| 0024318 | 12/1950 | Finland | 439/652 |
| 2438928 | 5/1980 | France . | |
| 1200410 | 4/1966 | Germany . | |
| 24 01 547 | 7/1975 | Germany . | |
| 24 24 506 | 8/1975 | Germany . | |
| 42 27 629 | 2/1994 | Germany . | |
| 2917952 | 11/1980 | Netherlands | 439/652 |
| 2139019 | 4/1983 | United Kingdom . | |
| 2 180 415 | 9/1986 | United Kingdom . | |

*Primary Examiner*—Khiem Nguyen
*Assistant Examiner*—Eugene G. Byrd
*Attorney, Agent, or Firm*—Henry M. Feiereisen

[57] ABSTRACT

An adapter with incorporated components of a power supply for connection to a conventional power outlet, includes a casing having one end face which is formed with prongs for insertion into the power outlet. The casing accommodates contact sleeves which are in direct electric connection with the prongs and is formed with a socket-forming cavity for attachment of a plug. The socket has a bottom which is provided with bores in alignment with the contact sockets so as to form a continuous connection from the power outlet to the contact sleeves. The casing is further equipped with at least one additional terminal which is linked to a power supply or at least to components of the power supply.

4 Claims, 1 Drawing Sheet

ADAPTER FOR CONNECTION TO A POWER OUTLET

BACKGROUND OF THE INVENTION

The present invention refers to an adapter for connection to a conventional power outlet, and in particular to an adapter of a type incorporating at least components of a power supply.

Conventional adapters generally include only one connection for an outlet fed with electric energy from the outlet of the power supply and allowing attachment of small consumers, such as electric toothbrushes, shavers, hand-held vacuum cleaners, radios, CD players, walk-ins, telephone sets or cordless phones or the like. In many areas of daily life, small consumers are utilized which frequently are equipped with accumulators for mobile operation. These accumulators are charged by a charger e.g. a power supply incorporated in an adapter when the consumer is idle.

The adapter together with incorporated power supply are plugged in a socket or power outlet. Thus, the socket is occupied over an extended period and unusable for other consumers. This is inconvenient, in particular in the area of a bathroom because regulations require power outlets to be distanced by at least 1 m from the nearest water discharge location so that in most cases only one outlet is installed in the wall. Moreover, the existence of scattered cables in a wet area is annoying.

SUMMARY OF THE INVENTION

It is an object of the present invention to provide an improved adapter, obviating the afore-stated drawbacks.

This object and others which will become apparent hereinafter are attained in accordance with the present invention by providing the adapter with a casing having prongs which are directly attached to contact sleeves accommodated in the casing and provided for attachment of a plug, with the casing including a socket-forming cavity which has a bottom with bores in alignment with the contact sleeves, and by forming on the outside of the casing at least one further terminal which is linked with the power supply or components of the power supply.

With an adapter according to the present invention, it is ensured that even when the wall outlet is occupied by the adapter, a further consumer can still be plugged in without any problems because the direct electric linkage between the prongs and the contact sleeves forms another socket for attachment of a conventional plug.

Preferably, the casing is provided with a hollow plug-type projection for receiving the prongs and includes protective contacts which are connected with contact springs in an area of the socket-forming cavity. Thus, also shockproof plugs can be connected to the adapter according to the invention.

The adapter may incorporate a complete power supply or also only components thereof. In the latter case, the further components of the power supply may be arranged in a consumer connected to the adapter.

According to another feature of the present invention, the casing may be provided with a hollow pot-shaped mounting which projects integrally from a top side of the casing for receiving a charging coil with a magnetizable core. This creates a structurally very simple solution to inductively transmit electric energy to the consumer. The control circuit for the power supply may be incorporated within the consumer so that the adapter is required to have only the charging coil.

According to yet another feature of the present invention, the adapter is additionally provided with another socket-forming cavity on one side wall of the casing for maintaining connection pins which are connected with the power supply. Thus, in addition to the attachment of a consumer with a conventional plug, a further consumer equipped with conventional low voltage plugs can be plugged in the adapter.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
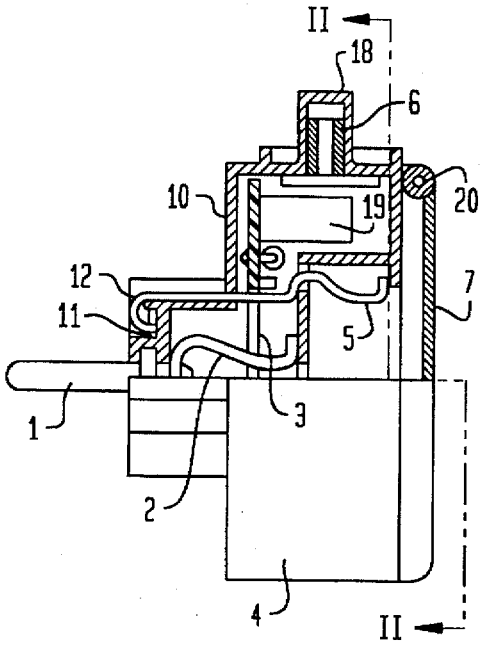
FIG. 1 shows a partially sectional side view of one embodiment of an adapter according to the invention, taken along the line I—I in FIG. 2.

Throughout all the Figures, the same or corresponding elements are always indicated by the same reference numerals.

Turning now to the drawing, and in particular to FIG. 1, there is shown a partially sectional side view of an adapter having a casing 4 formed on one end face with a plug-type hollow projection 11 in which prongs 1 are mounted. The prongs 1 traverse the projection 11 and are electrically connected directly to contact sleeves 2 which are secured within the interior of the casing 4. Extending on the outside of the projection 11 are protective contacts 12 which project into the interior of the casing 4 and are formed in one piece with safety contact springs 5. The contact springs 5 are supported by the inside wall of a socket-forming cavity 9 that is provided at a side in opposition to the projection 11 for receiving a conventional plug.

Figure 3:
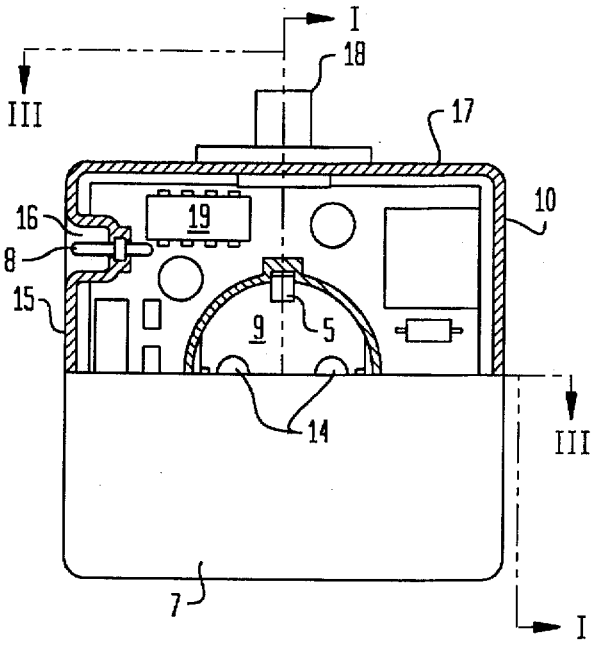
FIG. 3 is a partially sectional front view of the adapter, taken along the line III—III in FIG. 1.

As best seen in FIG. 3, the socket 9 has a bottom 13 which is formed with two bores 14 in alignment with the contact sleeves 2. Thus, prongs of a conventional plug can be inserted into the socket 9 and directed through the bores 14 into the contact sleeves 2.

Figure 2:
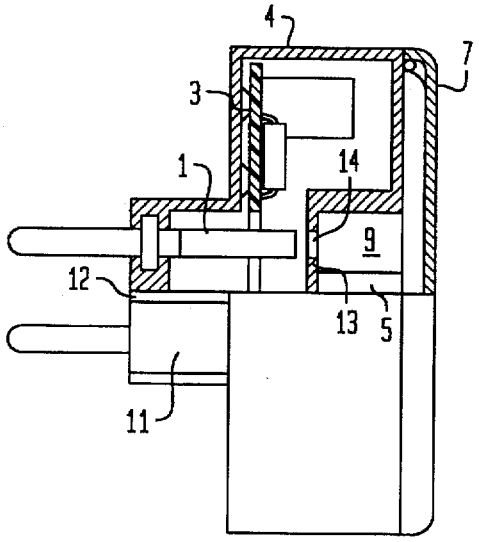
FIG. 2 is a partially sectional top view of the adapter, taken along the line II—II in FIG. 1.

The projection 11 is formed in one piece with a rear wall 10 of the casing 4. As shown in FIG. 2, the rear wall 10 supports a printed circuit board 3 which incorporates a power supply—illustrated in a simplified manner by a block 19—, with the power supply on the circuit board 3 having an input which is electrically connected to the prongs 1.

As shown in FIG. 3, the casing 4 is further provided on one side wall 15 with a second socket-forming cavity 16 which supports connection pins 8 for attachment of a low-voltage consumer. With their rear ends, the pins 8 are connected to one output of the power supply.

Formed on the top wall 17 of the casing 4 is an outwardly projecting pot-shaped mounting 18 which defines an interior for receiving a charging coil 6 with a magnetizable iron core. This charging coil 6 is essentially the primary winding of the power transformer of a power supply which is electrically connected with the prongs 1 via a conventional power supply input circuit. In this manner, a small consumer can be supplied inductively with electric energy. The charging coil 6 is thus provided for attachment of a small consumer e.g. an electric toothbrush, with the small consumer including a ring coil as secondary winding of the power transformer whereby the actual rectifier circuit and charging circuit is connected to the ring coil.

At operation, when the adapter according to the invention is plugged with its prongs 1 into a wall-mounted power outlet, the front wall allows attachment of a convention plug into the socket 9 as the electric energy from the outlet is transmitted from the prongs 1 to the contact sleeves 2. In addition a small consumer can be attached to the mounting 18 and a low voltage consumer can be inserted into the socket 16. The adapter which incorporates at least components of the power supply thus enables a supply of electric energy to a small consumer from the wall-mounted outlet via the connection pins 8 and/or the charging coil 6 and at a same time a supply of electric energy to a more powerful consumer which is plugged through the bores 14 into the contact sleeves 2.

It will be understood by persons skilled in the art that the adapter according to the invention may be formed with only connection pins 8 or only with the pot-shaped mounting 18 or with any combination thereof in a random number.

Suitably, the front of the adapter and thus the socket 9 is protected by a lid 7 which is swingably mounted at one end indicated by 20 to the casing 4, with the cover 7 being spring-loaded in direction to a closing position so that the socket 9 is automatically protected from the outside when not in use.

While the invention has been illustrated and described as embodied in an adapter for connection to a conventional power outlet, it is not intended to be limited to the details shown since various modifications and structural changes may be made without departing in any way from the spirit of the present invention.

What is claimed as new and desired to be protected by Letters Patent is set forth in the appended claims:

We claim:

1. An adapter for connection to a conventional power outlet, comprising a casing having one end face which is formed with prongs for insertion into the power outlet, said casing accommodating contact sleeves in direct electric connection with said prongs and being formed with a socket-forming cavity having a bottom provided with bores in alignment with said contact sockets for attachment of a plug, said casing being formed with at least one additional terminal which is linked to a power supply or at least to components of the power supply.

2. The adapter of claim 1 wherein said casing has a distal and a proximate end face with regard to said prongs, said socket-forming cavity being provided at said distal end face for guiding the plug, said casing being provided with a hollow plug-type projection for receiving said prongs, and further comprising protective contacts arranged in an area of said projection and contact springs connected to said protective contacts and extending in an area of said socket-forming cavity.

3. The adapter of claim 1 wherein said casing is formed with a hollow pot-shaped mounting for accommodating a charging coil with a magnetizable core.

4. The adapter of claim 1 wherein said casing has a side wall with a second socket-forming cavity provided with connection pins projecting into said second socket-forming cavity and connected with an outlet of the power supply.

* * * * *